US005230614A

United States Patent [19]

Zanger et al.

[11] Patent Number: 5,230,614

[45] Date of Patent: Jul. 27, 1993

[54] REDUCED PULSATION TAPERED RAMP PUMP HEAD

[75] Inventors: Frank Zanger, Hayward; Tim Surber, San Leandro; Susanne Roslon, Laguna Niguel, all of Calif.

[73] Assignee: Allergan, Inc., Irvine, Calif.

[21] Appl. No.: 892,788

[22] Filed: Jun. 3, 1992

[51] Int. Cl.[5] ..... F04B 43/12

[52] U.S. Cl. ..... 417/477

[58] Field of Search ..... 417/477

[56] References Cited

U.S. PATENT DOCUMENTS 2,965,041 12/1960 Clark ..... 417/477 X
4,181,476 1/1980 Malbec ..... 417/477
4,708,604 11/1987 Kidera ..... 417/477
4,976,590 12/1990 Baldwin ..... 417/477 X

OTHER PUBLICATIONS

Pisula, "As Tubing Goes, So Goes the Pump", Research & Development, Jun. 1989.

*Primary Examiner*—Richard E. Gluck
*Attorney, Agent, or Firm*—Walter A. Hackler

[57] ABSTRACT

A peristaltic pump includes a plurality of rollers for compressing and sealing a collapsible and resilient tube. A housing and a pump arm with a specific arcuate surface and position with respect to the housing enable the succesive contact and gradual compression of the rollers with the tube in a manner for moving a fluid through the tube in one direction without creating substantial fluid back pressure in an opposite direction.

8 Claims, 3 Drawing Sheets

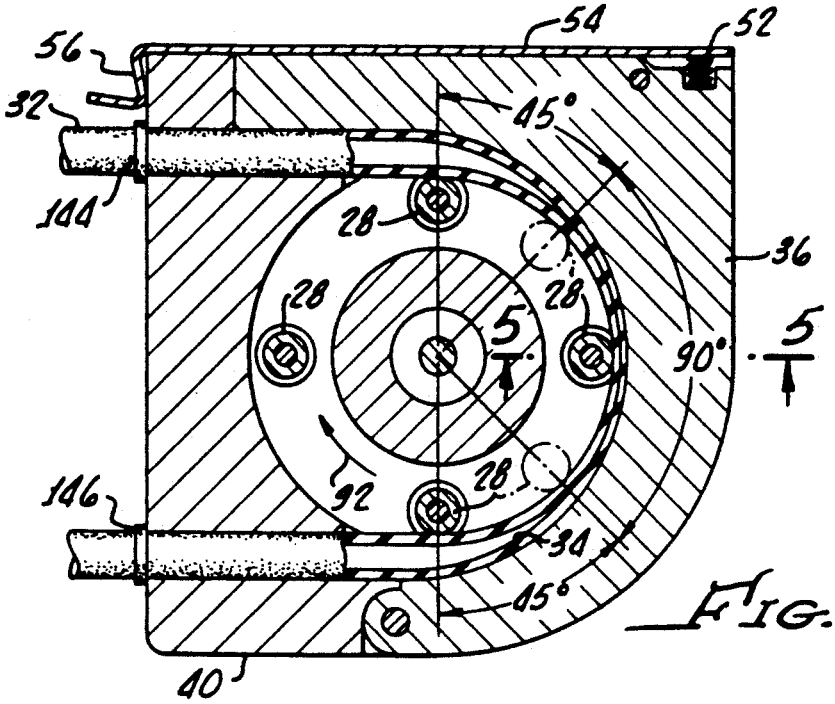
FIG. 3.
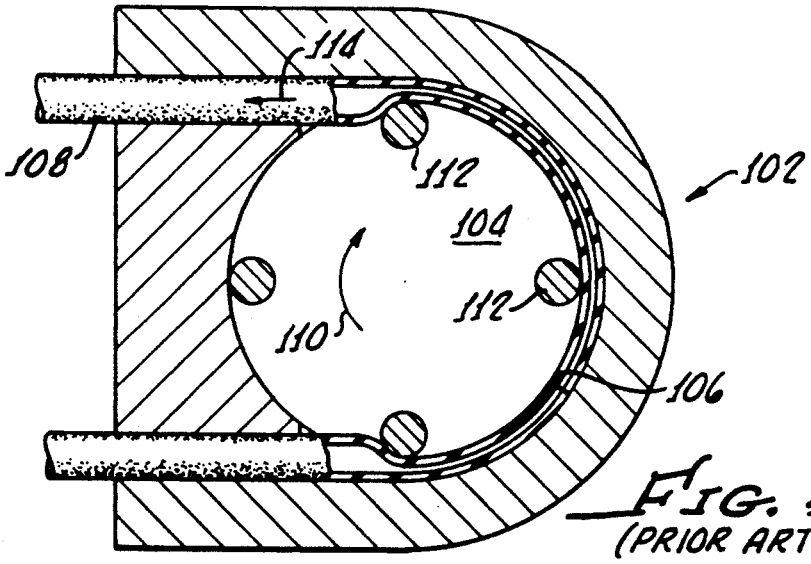
FIG. 4.
(PRIOR ART)
FIG. 5a. (PRIOR ART)
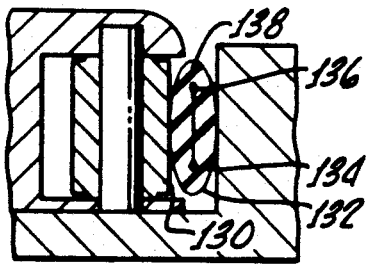
FIG. 5.
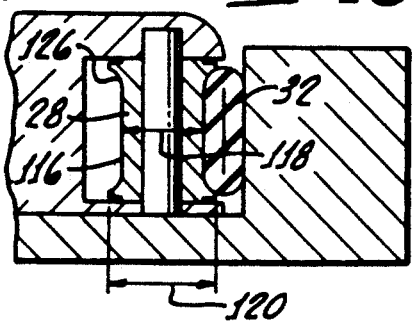

REDUCED PULSATION TAPERED RAMP PUMP HEAD

The present invention generally relates to peristaltic pumps and more particularly to precision peristaltic pumps, particularly suitable for the simultaneous removal and replacement of fluids in an eye cavity during ophthalmic surgery as, for example, for the removal of cataracts.

The necessity for precisely controlling pressure in the eye during surgery is well-known. During surgery on normally pressurized eyes, instruments are passed through small incisions of the cornea in order to access and remove opaque cataract material clouding the lens.

Cataracts within the lens may be broken up by cutting apparatus or by ultrasonic apparatus and the fractured material aspirated, together with a quantity of aqueous fluid in the eye chamber.

The aqueous fluid is simultaneously replaced in order to maintain a normal pressure in the eye.

While pressure may be controlled by a pressure regulation device, greater pressure stability may be assured through the use of a pump having minimal back pressure or pump pulsations.

Severe reductions in the eye pressure will result in collapse of the eye chamber, but aside from these traumatic results, the maintenance of proper pressure within an eye during surgical procedures is important to preserve and stabilize the spatial relationships of the intraocular tissues. Thus, variations of pressure during an operation may impair the surgeon's ability to observe and operate on intraocular tissues.

The present invention provides a peristaltic pump having significantly reduced pump pulsations and therefore particularly suitable for use in surgical procedures such as those hereinabove described.

SUMMARY OF THE INVENTION

A peristaltic pump in accordance with the present invention generally includes a plurality of tube compression means for compressing and sealing a collapsible and resilient tube. Housing means is provided for guiding the collapsible and resilient tube to and from the tube compression means and means are provided for causing the plurality of tube compression means to successively contact, gradually compress and seal the compressible and resilient tube and thereafter gradually uncompress the tube in order to move a fluid through the tube in one direction without creating substantial fluid back pressure in the opposite direction.

More particularly, the plurality of tube compression means may comprise a plurality of rollers and the means for causing the plurality of tube compression means to contact, compress and seal the tube comprises a pump arm, having an arcuate surface, and mounted to the housing means in a position enabling the rollers to contact, compress and seal the tube.

Still more particularly, the peristaltic pump in accordance with the present invention may further include assembly head means for supporting the plurality of rollers in a circular pattern about an assembly head axis with each roller having a rotation axis generally parallel to the assembly head axis.

Specifically, the arcuate surface is configured and the pump arm position with respect to the assembly head so that as the assembly head is rotated, each roller successively contacts the tube, gradually compresses and seals the tube during an approximate 45° rotation of the assembly head. Additionally, the arcuate surface is configured with the pump arm position with respect to the assembly head so that each roller successively releases a tube during a rotation of the assembly head about 45°.

The arcuate surface is configured and the pump arm positioned with respect to the assembly head so that each roller maintains a sealing engagement with the tube during approximately a 45° rotation of the assembly head.

In order for uniformly sealing the tube as the roller compresses the tubing, each roller may include a specific circumferential surface thereon. Particularly, each roller may have an inside diameter that is smaller than a roller diameter at each end of the roller, and this smaller diameter may be constant between end diameters on each roller, with the end diameters interconnected with the constant diameter by an arcuate surface.

In combination, the present invention may also include a collapsible resilient tube which includes means for preventing movement of the tube itself through the housing means. Particularly, the means for preventing movement of the tube may include at least one collar disposed on the tube having a diameter sufficient to prevent entry of the collar into the housing means.

BRIEF DESCRIPTION OF THE DRAWINGS invention will be better understood by the following description when considered in conjunction with the accompanying drawings in which:

FIG. 3 is a cross-section view of the peristaltic pump in accordance with the present invention showing a plurality of rollers for compressing a resilient tube against a pump arm arcuate surface;

FIG. 4 is a cross-section of a prior art peristaltic pump showing the relationship between the rollers and the pump arm arcuate surface;

FIG. 5 is a cross-section view of a roller in accordance with the present invention taken along the line 5—5 shown in FIG. 3;

Figure 6:
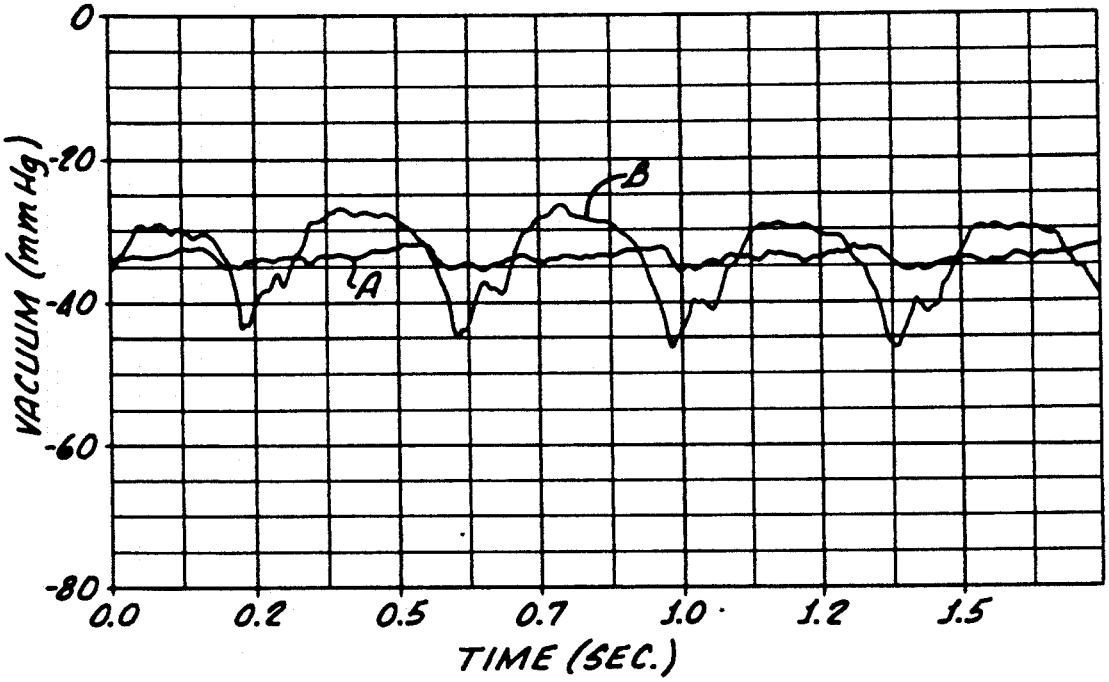
Figure 7:
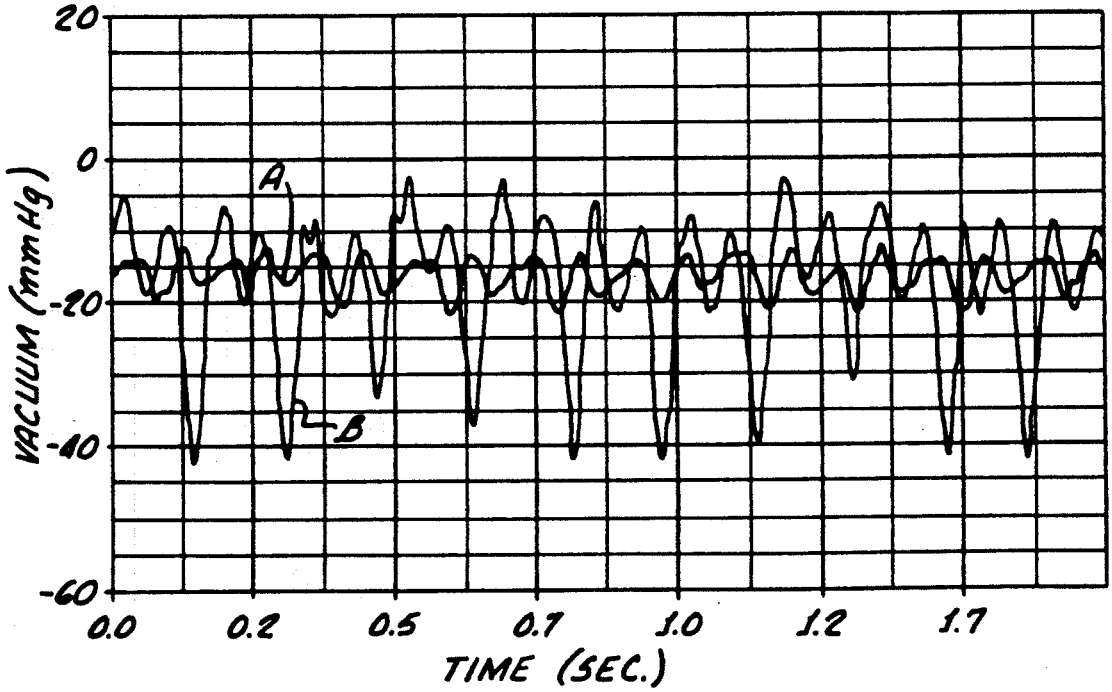

FIG. 5*a* is a cross-section view of a prior art roller for a peristaltic pump showing incomplete sealing of a tube;

FIG. 6 is a plot of vacuum pressure as a function of time for both a prior art peristaltic pump and a peristaltic pump in accordance with the present invention, showing in comparison a significant reduction in back pressure during operation of the peristaltic pump made in accordance with the present invention operating at flow rate of about 10 ccs per minute; and FIG. 7 is a plot similar to the plot shown in FIG. 6 showing the vacuum as a function of time for both prior art pumps and a pump in accordance with the present invention at a flow rate of about 40 ccs per minute.

DETAILED DESCRIPTION OF THE DRAWINGS

Figure 1:
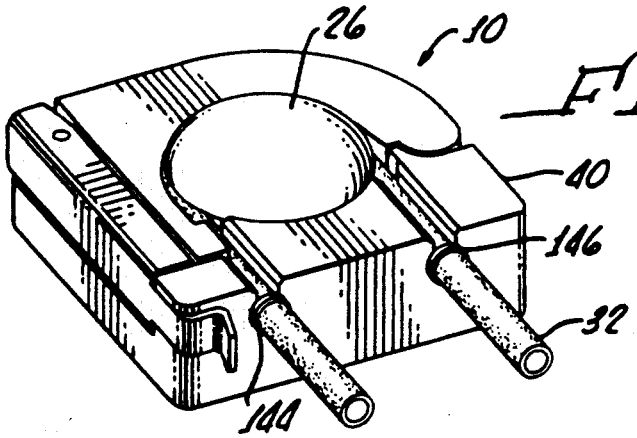
FIG. 1 is a perspective view of an assembled peristaltic pump in accordance with the present invention.
Figure 2:
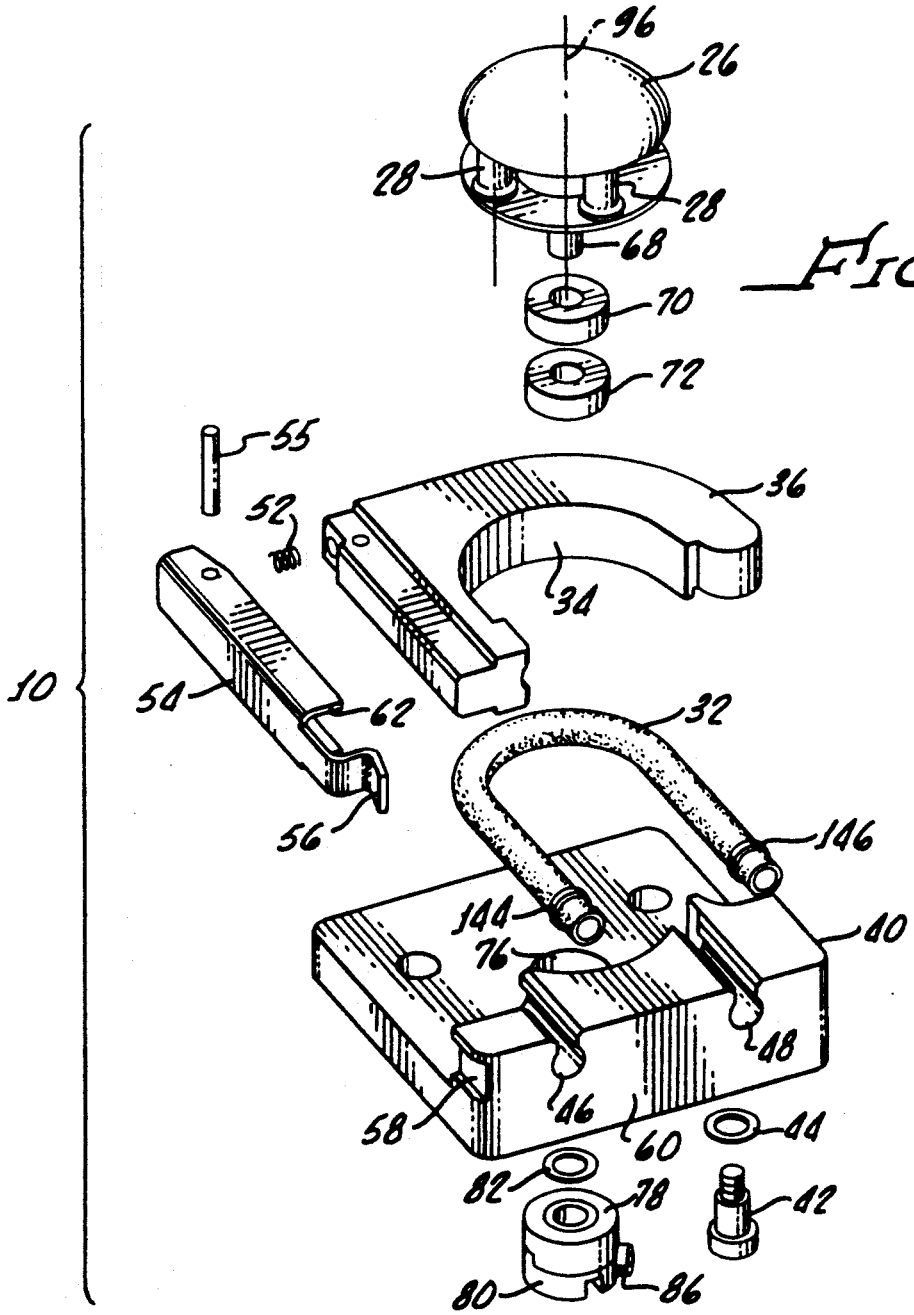
FIG. 2 is a perspective exploded view of the peristaltic pump shown in FIG. 1.

Turning now to FIGS. 1 and 2, there is shown a peristaltic pump 10 in accordance with the present invention generally including an assembly head 26 which provides a means for supporting a plurality of rollers 28 with the latter providing compression means for compressing and sealing a collapsible and resilient tube 32 against an arcuate surface 34 on a pump arm 36.

The pump arm 36 is pivotally mounted to a housing 40 by means of a pin 42 and washer 44 for enabling movement thereof to facilitate insertion and removal of the tube 32. Apertures 46 48 in the housing 40 enable the housing to provide means for guiding the collapsible and resilient tube 32 to and from the arcuate surface 34 and rollers 28.

A spring 52 loaded latch 54 pivotally mounted to the pump arm 36 by a pin 55 enables locking of the pump arm 36 to the housing after insertion of the tube through the apertures 46 and 48, and during operation of the pump. This locking is enabled by the tongue 56 which snaps over a recess 58 in the housing 40, securing a front housing wall 60 between the tongue 56 and a rear portion 62 of the latch 54.

The assembly head 26 is rotatably attached to the housing 40 by way of an axle 68 which passes through bearings 70, 72, a bore 76 in the housing 40 and a hub 78 and coupling 80. The axle 68 is retained in position by a clip 82 in a conventional manner along with a set screw 86.

As will be hereinafter discussed in great detail, the pump arm 36 with arcuate surface 34 is positioned with respect to the assembly head rollers 28 to provide a means for gradually compressing and sealing the collapsible and resilient tube 32 and thereafter gradually uncompressing the tube 32 in order to move a fluid (not shown) through the tube 32 in a direction indicated by the rotation area 92 without creating substantial fluid back pressure in a direction opposite that of the area 92. The spatial relationship provided by the mounting of the assembly head 26 and arcuate surface 32 is more clearly shown in FIG. 3.

It should be appreciated that while four rollers 28 are shown mounted in a circular pattern about an assembly head axis 96, a larger or smaller number of rollers may be suitable depending upon pumping requirements. As shown, each roller 28 includes a roller axis 100 which is generally parallel to the assembly head axis 96.

As shown in FIG. 3, the arcuate surface 34 is configured and the pump arm 36 positioned with respect to the assembly head 26 so that as the assembly head 26 is rotated in the direction of arrow 92, each roller 28 successively contacts the tube 32, gradually compresses and seals the tube 32 during approximately a 45° rotation of the assembly head 26.

Further configuration of the arcuate surface 34 and position of the pump arm 36 with respect to the assembly head 26 enables each roller to gradually release the tube during a rotation of the assembly head 26 of about 45°. This configuration also enables each roller to remain in a sealing engagement with the tube 32 during approximately a 90° rotation of the assembly head 26.

This is to be contrasted with a prior art peristaltic pump 102 in which positioning of prior art assembly heads 104 with pump arm arcuate surfaces 106 is shown in FIG. 4. In the prior art arrangement, sealing of the tube 108 occurs in a small angular rotation (In the direction of arrow 110) of the prior art assembly head 104. This results in movement of fluid within the prior art tube 108 away from the compressing prior art roller 112 which causes significant back pressure in the prior art tube 108 as indicated by the arrow 114.

To further enhance the efficient and reliable sealing of the tube 32 by the rollers 28 in the pump 10, according to the present invention, a specific circumferential surface 116 on the rollers 28 is provided, as shown in FIG. 5.

As shown, each roller 28 has an inside diameter 18 which is smaller than roller diameters 120 at each end 122, 124 of each roller. This inside diameter 118 is constant between the end diameters 120 and the end diameters 120 are interconnected with the inside diameter 118 by arcuate surface 126.

This generally U-shaped cross-section of the roller provides for uniform sealing tube 32 as shown in FIG. 5 which is not possible with a flat or uniform diameter roller 130, see FIG. 5*a*. As shown in cross-section in FIG. 5-A, the prior art roller 130 provides incomplete sealing of a tube 132 because the circular nature of the tube inside diameter results in end voids 134 136 unless sufficient pressure is exerted to collapsible the tube side 138.

However, such increased pressure by the rollers 112 may lead to excessive tube wear and may further result in a excess loading on the assembly head 104 and rollers 112.

In order to prevent movement of the tube 32 through the housing 40, collars 144 146 may be attached or molded into the tube at a spaced apart distance from one another in order that each collar is positioned abutting the housing front 40 upon assembly of the tube 32 into the housing 40 and around the rollers 28. The collar diameter is chosen in order to prevent entry of the collar into the housing means 40. It has been found that reliable and efficient performance of the pump is provided when the compressible and resilient tube is formed from silicon having a hardness of about 55 durometers, Shore A, platinum or peroxide cure method, and a typical tubing size is three-eighth inch. Preferably the tube is formed from a peroxide cure silicon, said cure being well known in the art.

This size tube enables pumping volumes of up to about 40 cc/minute when the assembly head is rotated at up to about 75 rpm.

The hereinabove described arrangement of the assembly head 26, rollers 28, and pump head 36 with arcuate surface 34 using the hereinabove referenced tube 32 configuration enables a significant reduction in back pressure as compared to a prior art peristaltic pump 102 having the same overall dimensions and operated at the same volume output. This is clearly shown in FIGS. 6 and 7 which are plots of the vacuum drawn by the pump as a function of time for pumping volumes of about 10 cc per minute and 40 cc per minute.

Curves A in both FIGS. 6 and 7 represent the prior art pump performance while Curves B in FIGS. 6 and 7 represent the results of a peristaltic pump configured in accordance with the present invention.

It can be easily seen from FIG. 6 that the vacuum variation on the intake of the pump 10 in accordance with the present invention operating at about 10 ccs per minute is less than plus or minus 4 mm Hg at a vacuum of about 18 mm Hg. This is to be compared with the vacuum variation on the intake of the prior art pump 102 which is about plus or minus 8 mm Hg at 10 ccs per minute. Thus the change in back pressure of the pump 10 in accordance with the present invention over the prior art pump 102 is a factor of two.

An even greater inprovement in reduced vacuum variation or back pressure is exhibited by the pump 10 in accordance with the present invention when operating at a higher flow rate. This is shown in FIG. 7 wherein the variation of vacuum for the pump 10 is about plus or minus 5 Hg whereas the variation of vacuum for the prior art pump 102 is about plus or minus 15 Hg. A factor of about 3 improvement.

Although there has been hereinabove described a specific peristaltic pump in accordance with the present invention, for the purpose of illustrating the manner in which the invention may be used to advantage, it should be appreciated that the invention is not limited thereto. Accordingly, any and all modifications, variations, or equivalent arrangements which may occur to those skilled in the art, should be considered to be within the scope of the present invention as defined in the appended claims.

What is claimed is:

1. A peristaltic pump comprising:

assembly head means for supporting a plurality of rollers, said rollers being mounted in an arcuate pattern about an assembly head axis, each roller having a rotation axis generally parallel to the assembly head axis;

a collapsible and resilient tube;

housing means for rotatably mounting said assembly head and for guiding the collapsible and resilient tube over said rollers;

a pump arm having an arcuate surface and mounted to said housing means in a position enabling said rollers to compress the tube against the arcuate surface as the assembly head is rotated, said arcuate surface being shaped and positioned with respect to said assembly head so that as the assembly head is rotated, each roller successively contacts the tube and gradually seals the tube during approximately a 45° rotation of the assembly head, said pump arm being pivotally mounted to said housing means; and means for rigidly positioning and locking the pump arm in a closed position enabling said rollers to compress the tube against the arcuate surface.

2. The peristaltic pump according to claim 1 wherein said plurality of tube compressor means comprises four rollers.

3. The peristaltic pump according to claim 2 wherein each roller comprises means, defining a circumferential surface thereon, for uniformly sealing the tube as each roller compresses the tubing.

4. The peristaltic pump according to claim 3 wherein said collapsible and resilient tube comprises means for preventing movement of the tube through the housing means.

5. The peristaltic pump according to claim 4 wherein said means for preventinq movement of the tube comprises at least one collar disposed on said tube and having a dimension sufficient to prevent entry of the collar into the housing means.

6. The peristaltic pump according to claim 5 wherein each roller has an inside diameter that is smaller than roller diameters at each end of each roller.

7. The peristaltic pump according to claim 6 wherein each roller has a constant diameter extending between end diameters of each roller, said end diameters being greater than said constant diameter.

8. The peristaltic pump according to claim 7 wherein said end diameters are interconnected with said constant diameter by an arcuate surface.

* * * * *